US005598781A

United States Patent [19]

Osawa et al.

[11] Patent Number: 5,598,781

[45] Date of Patent: Feb. 4, 1997

[54] AUTOMATIC PLATE EXCHANGE/PLATE REGISTRATION METHOD AND APPARATUS

[75] Inventors: Fumio Osawa; Hideo Watanabe; Masatsugu Sekine, all of Ibaraki; Taro Shimanuki, Yamagata, all of Japan

[73] Assignee: Komori Corporation, Japan

[21] Appl. No.: 675,417

[22] Filed: Jul. 3, 1996

Related U.S. Application Data

[63] Continuation of Ser. No. 300,074, Sep. 2, 1994, abandoned, which is a continuation of Ser. No. 112,639, Aug. 25, 1993, abandoned, which is a continuation of Ser. No. 947,401, Sep. 18, 1992, abandoned.

[30] Foreign Application Priority Data

Sep. 19, 1991 [JP] Japan ..... 3-266985

[51] Int. Cl.[6] ..... B41F 27/06; B41F 33/16

[52] U.S. Cl. ..... 101/477; 101/486

[58] Field of Search ..... 101/484, 485, 101/486, 477, 415.1, 378, 181, 216, 483, 136, 137, 141, 174, 183

[56] References Cited

U.S. PATENT DOCUMENTS 5,111,744 5/1992 Wieland ..... 101/415.1 X

FOREIGN PATENT DOCUMENTS 0096564 12/1983 European Pat. Off. .
0432660A2 7/1990 European Pat. Off. .
435413 7/1991 European Pat. Off. ..... 101/415.1
3144643A1 11/1981 Germany .
2-204038 4/1989 Japan .
3-176152 7/1991 Japan .

*Primary Examiner*—J. Reed Fisher
*Attorney, Agent, or Firm*—Blakely Sokoloff Taylor & Zafman

[57] ABSTRACT

In an automatic plate exchange/plate registration method and apparatus, a current position of a plate cylinder on which a plate to be exchange is mounted is stored. The plate cylinder is reset to an origin. Automatic plate exchange is performed when the plate cylinder is at the origin. The plate cylinder is automatically returned to the stored current position.

2 Claims, 4 Drawing Sheets

AUTOMATIC PLATE EXCHANGE/PLATE REGISTRATION METHOD AND APPARATUS

This is a continuation of application Ser. No. 08/300,074 filed on Sep. 2, 1994, now abandoned which is a continuation of application Ser. No. 08/112,639 filed on Aug. 25, 1993, now abandoned which is a continuation of application Ser. No. 07/947,401, filed on Sep. 18, 1992, now abandoned.

BACKGROUND OF THE INVENTION

The present invention relates to an automatic plate exchange/plate registration method and apparatus of a printing press, e.g., a rotary press, which reset a plate cylinder to an origin, perform automatic plate exchange, and thereafter return the plate cylinder to a position immediately before it is reset to the origin.

Recently, a printing press, e.g., a rotary press, employs an automatic plate exchange apparatus (e.g., refer to Japanese Patent Application No. 1-315381) for automatically exchanging a plate mounted on a plate cylinder.

In the automatic plate exchange apparatus of this type, the plate cylinder must be reset to a position (origin) optimum for exchange before automatic plate exchange is performed. That is, a separate plate registration control apparatus is used, and the plate cylinder is returned to the center (the center of the machine) of the possible operation range in the axial direction by operating a reset switch provided to the control apparatus.

When the plate cylinder is at the origin, the operation of the automatic plate exchange apparatus is started to exchange an old plate mounted on the plate cylinder with a new plate.

After the plate exchange operation is completed, the moving position of the plate cylinder in the axial direction is adjusted so that the center of the flow of the web coincides with the center of the right-and-left direction (axial direction of the plate cylinder) of the mounted new plate. To adjust the position of the plate cylinder, the plate registration control apparatus is used, and the motor is turned on/off by a switch operation while observing a numerical indicator provided to the control apparatus.

This operation will be described by way of a rotary press with reference to FIG. 4. A center $\phi a$ of a web 1 in the flowing direction does not necessarily coincide with a center $\phi b$ of the machine. That is, when the plate cylinder is at the origin, assume that the center in the right-and-left direction of a new plate 2 coincides with the center $\phi b$ of the machine. Due to the individual characteristics of the printing press and the like, a deviation $\Delta\phi$ is caused between the center $\phi b$ of the new plate 2 in the right-and-left direction and the center $\phi a$ of the web in the flowing direction. The position of a plate cylinder 3 is adjusted in order to eliminate this deviation $\Delta\phi$, i.e., to perform plate registration.

In the method described above, however, the operator must move around between the automatic plate exchange apparatus and the plate registration control apparatus. That is, the operator must operate the reset switch of the plate registration control apparatus, then start automatic plate exchange by the automatic plate exchange apparatus, and return to the plate registration control apparatus to adjust the position of the plate cylinder. This poses much load to the operator to degrade the operation efficiency.

Furthermore, it is cumbersome to adjust the position of the plate cylinder by the plate registration control apparatus, thus increasing the load to the operator and degradation in operation efficiency.

SUMMARY OF THE INVENTION

It is an object of the present invention to provide an automatic plate exchange/plate registration method and apparatus, capable of reducing a load to an operator and improving operation efficiency.

In order to achieve the above object according to an aspect of the present invention, there is provided an automatic plate exchange/plate registration method comprising the steps of storing a current position of a plate cylinder on which a plate to be exchange is mounted, resetting the plate cylinder to an origin, performing automatic plate exchange when the plate cylinder is at the origin, and automatically returning the plate cylinder to the stored current position.

In order to achieve the above object according to another aspect of the present invention, there is provided an automatic plate exchange/plate registration apparatus comprising origin resetting means for storing a current position of a plate cylinder on which a plate to be exchanged is mounted and resetting the plate cylinder to the origin, automatic plate exchange means for performing automatic plate exchange after the plate cylinder is reset to the origin by the origin resetting means, and automatic returning means for automatically returning the plate cylinder to the stored current position after plate exchange by the automatic plate exchange means is completed.

Hence, according to the present invention, after the plate cylinder is reset to the origin, automatic plate exchange is performed. When plate exchange is completed, the plate cylinder is automatically returned to the initial position (position immediately before being reset to the origin).

DETAILED DESCRIPTION OF THE PREFERRED EMBODIMENT

The present invention will be described in detail.

Figure 2:
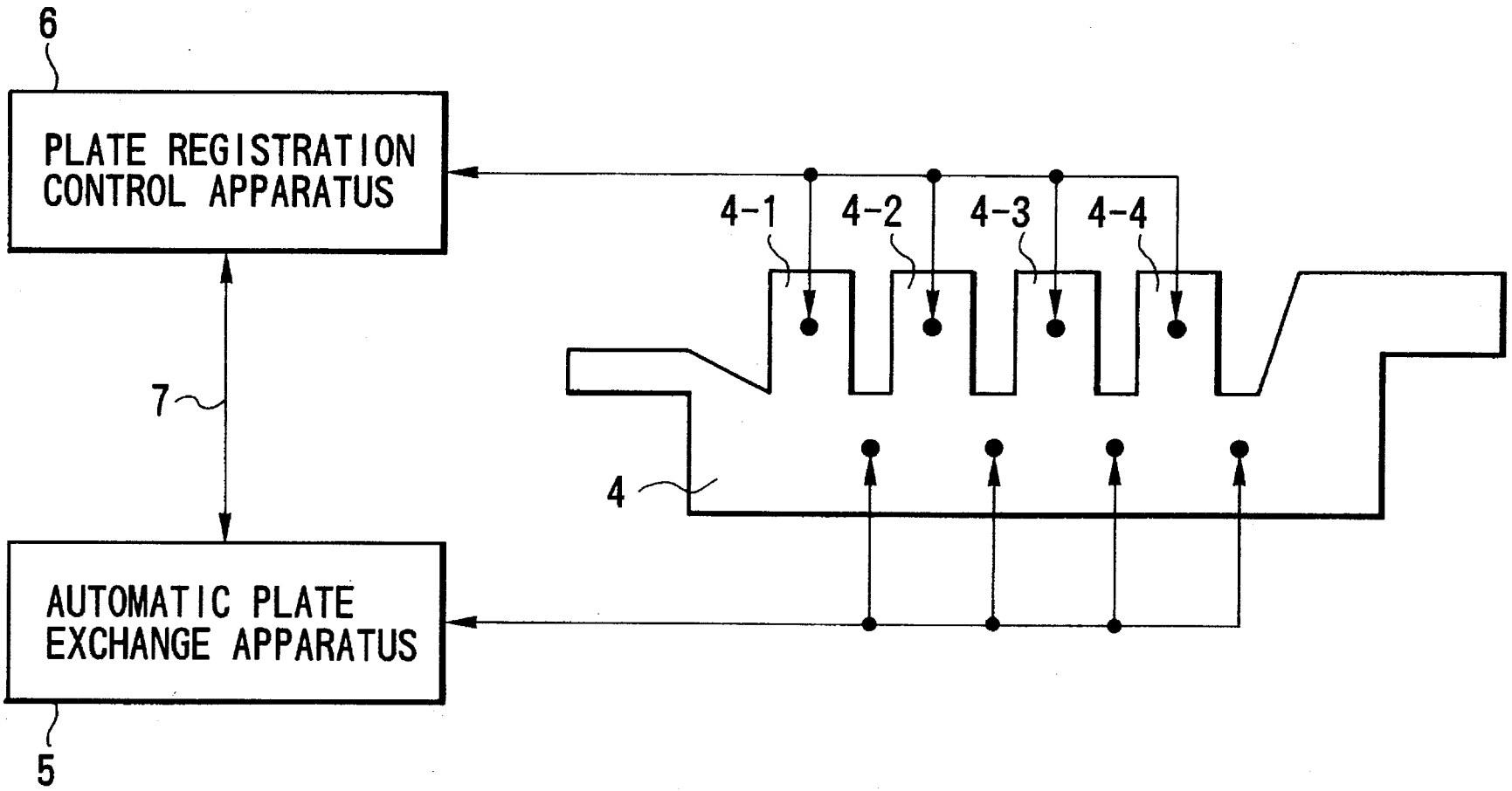
FIG. 2 is a diagram showing the main part of the printing press to which the automatic plate exchange/plate registration method according to the present invention is applied.

FIG. 2 shows the main part of a printing press to which an automatic plate exchange/plate registration method according to the present invention is applied. Referring to FIG. 2, reference numeral 4 denotes a rotary press; 5, an automatic plate exchange apparatus provided to the rotary press 4; and 6, a plate registration control apparatus provided to the rotary press 4.

The rotary press 4 has printing units 4-1 to 4-4. Although not shown in FIG. 2, each printing unit incorporates a plate cylinder on which a desired plate is mounted.

Figure 3:
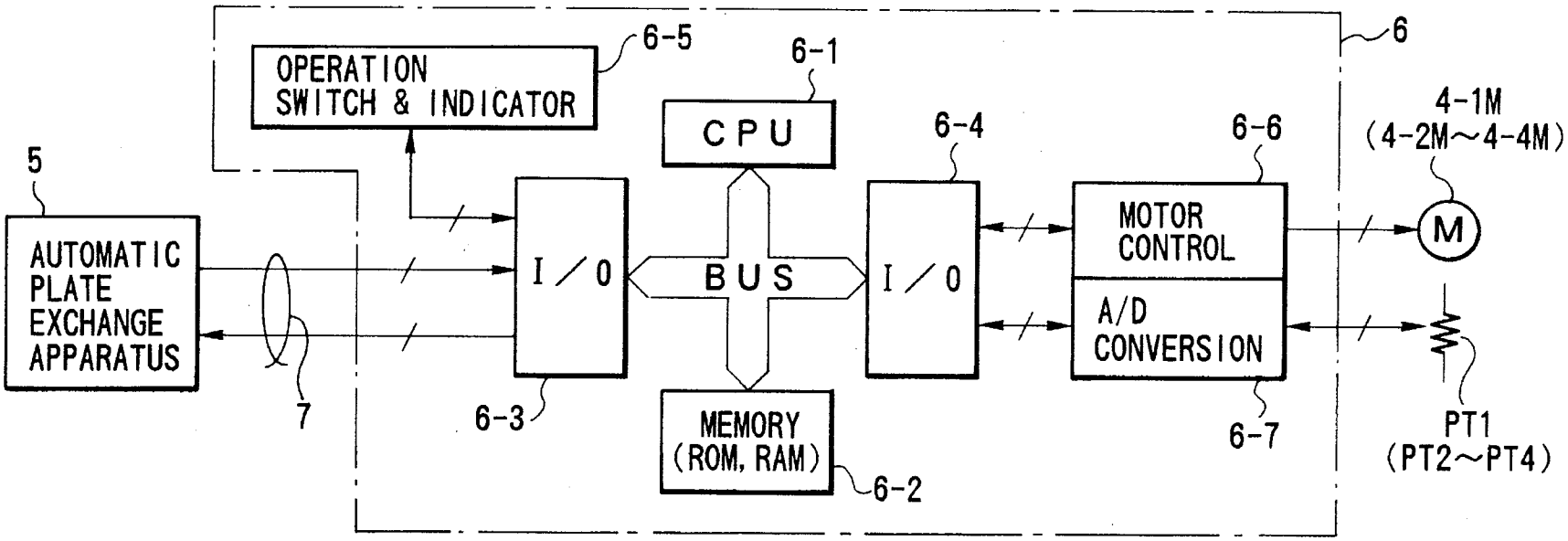
FIG. 3 is a block diagram showing the main part of the plate registration control apparatus of the printing press.

FIG. 3 is a block diagram showing the main part of the plate registration control apparatus 6. The plate registration control apparatus 6 has a CPU 6-1 as its major component, a memory (including ROM and RAM) 6-2, and I/O ports 6-3 and 6-4, all of which are connected to each other through a bus BUS. An operation switch & indicator 6-5 is connected to the I/O port 6-3, and a motor controller 6-6 and an A/D converter 6-7 are connected to the I/O port 6-4.

The motor controller 6-6 supplies drive commands to motors 4-1M to 4-4M of the printing units 4-1 to 4-4 to move the corresponding plate cylinders in the axial direction. The A/D converter 6-7 converts rotating positions (analog values) of the motors 4-1M to 4-4M detected by position sensors PT1 to PT4, e.g., potentiometers, to digital values, and sends them to the I/O port 6-4.

The plate registration control apparatus 6 and the automatic plate exchange apparatus 5 are connected to each other through an input/output line 7. That is, the automatic plate exchange apparatus 5 comprising a CPU, a memory, I/O ports, and the like that are similar to those of the plate registration control apparatus 6 is connected to the I/O port 6-3 of the plate registration control apparatus 6 through the input/output line 7.

An automatic plate exchange/plate registration operation of the rotary press 4 will be described with reference to FIGS. 1(*a*) and 1(*b*).

Figure 1A:
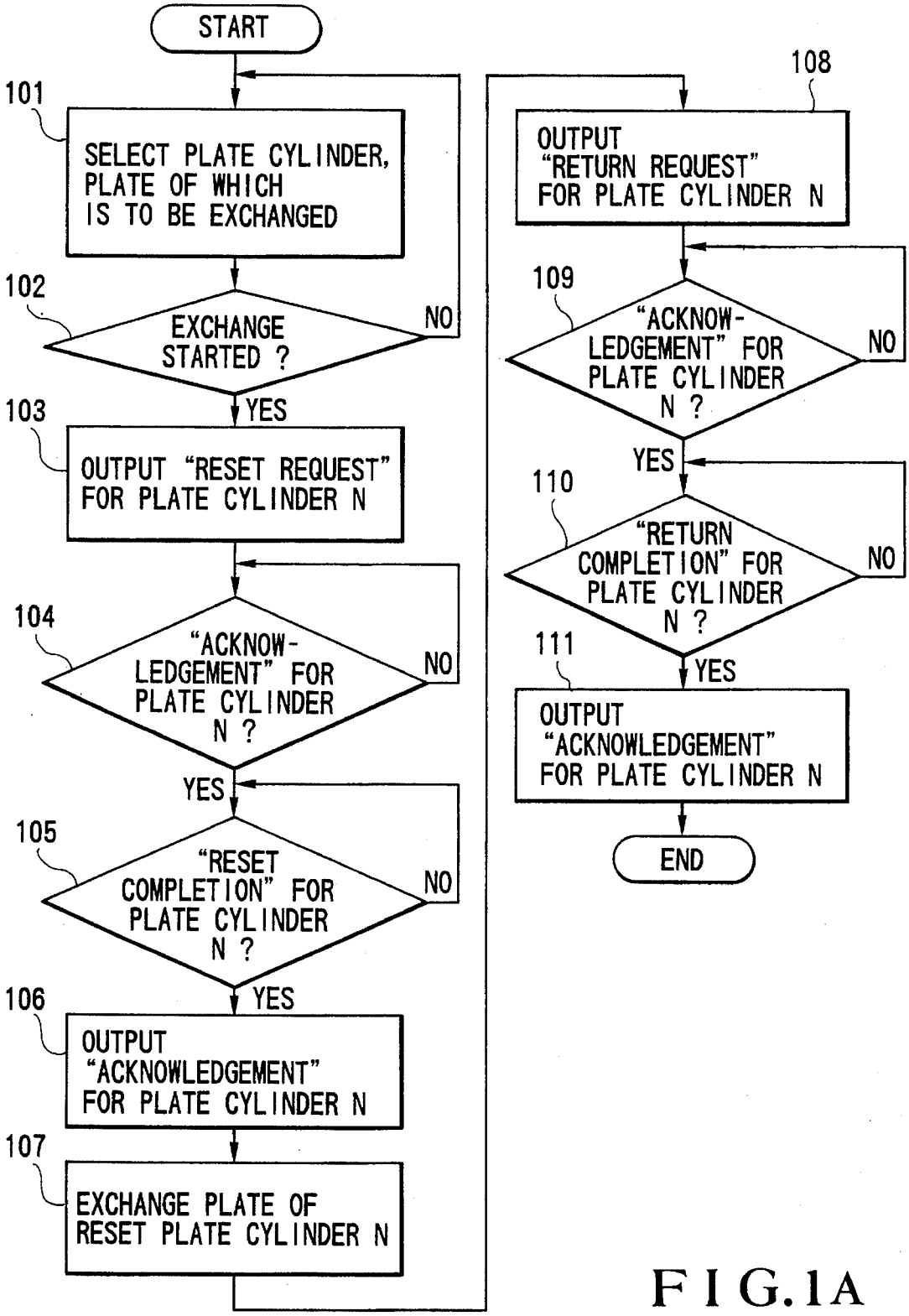
FIGS. 1(*a*) and 1(*b*) are flow charts showing an operation of an automatic plate exchange apparatus and a plate registration control apparatus, respectively, of a printing press shown in FIG. 2.
Figure 1B:
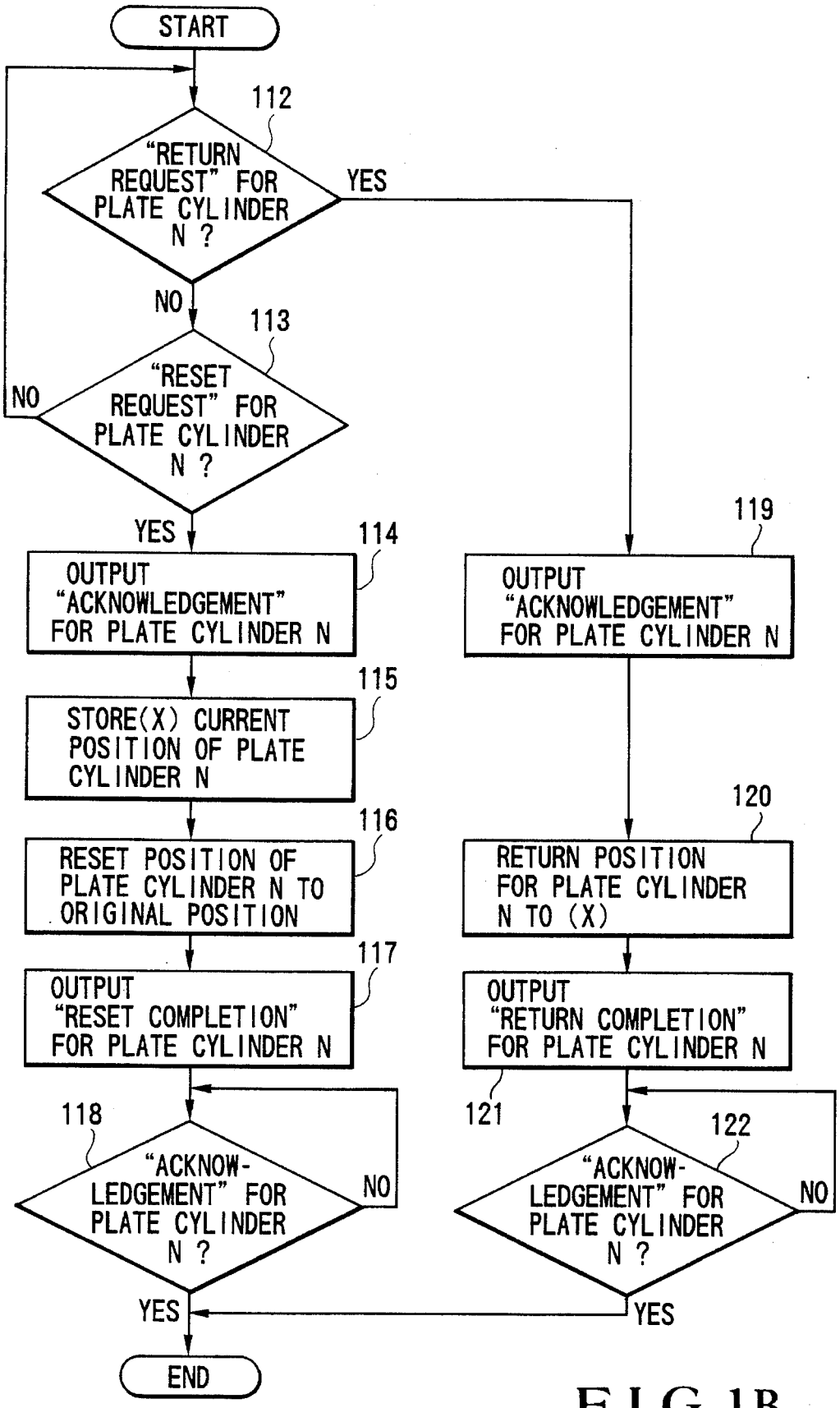

FIG. 1(*a*) shows the operation of the automatic plate exchange apparatus 5, and FIG. 1(*b*) shows the operation of the plate registration control apparatus 6.

Assume that the plate mounted on a plate cylinder n, where n, denotes a plate cylinder of the printing unit 4-1 of the rotary press 4, is to be exchanged.

In this case, in the automatic plate exchange apparatus 5, the plate cylinder n the plate of which is to be exchanged is selected (step 101), and start of exchange is instructed (step 102). Hence, the automatic plate exchange apparatus 5 designates the plate cylinder n and outputs a "reset request" (step 103). The "reset request" is supplied to the plate registration control apparatus 6 through the input/output line 7.

The plate registration control apparatus 6 confirms the "reset request" from the automatic plate exchange apparatus 5 (step 113) and outputs an "acknowledgement" indicating that this "reset request" is accepted (step 114). The control apparatus 6 stores the current position (x) of the plate cylinder n and resets the plate cylinder n to the origin (the center of the machine) (step 116). When the plate cylinder n is reset to the origin, the control apparatus 6 outputs a "reset completion" (step 117), and advances to step 118.

The "acknowledgement" output in step 114 is supplied to the automatic plate exchange apparatus 5 through the input/output line 7. The plate exchange apparatus 5 confirms this "acknowledgement" (step 104) and advances to step 105. In step 105, the plate exchange apparatus 5 confirms the "reset completion" output from the plate registration control apparatus 6 in step 117, and outputs an "acknowledgement" indicating that this "reset completion" is accepted (step 106). This "acknowledgement" is supplied to the control apparatus 6 and confirmed in preceding step 118.

The automatic plate exchange apparatus 5 advances to step 107 through step 106 to automatically exchange the plate cylinder n which has been reset to the origin. After this automatic plate exchange operation is completed, the exchange apparatus 5 outputs a "return request" for the plate cylinder n (step 108). This "return request" is supplied to the control apparatus 6 through the input/output line 7.

The control apparatus 6 confirms the "return request" from the exchange apparatus 5 (step 112) and outputs an "acknowledgement" indicating that this "return request" is accepted (step 119). Then, the control apparatus 6 returns the plate cylinder n to the current position (x) which is stored in advance in step 115 (step 120). Thus, the plate cylinder n is automatically returned to the initial position, i.e., the position immediately before it is reset to the origin. When the plate cylinder n is returned to the initial position, the control apparatus 6 outputs a "return completion" (step 121) and advances to step 122.

The "acknowledgement" output in step 119 is supplied to the automatic plate exchange apparatus 5 through the input/output line 7. The exchange apparatus 5 confirms the "acknowledgement" (step 109) and advances to step 110. In step 110, the exchange apparatus 5 confirms the "return completion" output from the plate registration control apparatus 6 in step 121 and outputs an "acknowledgement" indicating that this "return completion" is accepted (step 111). This "acknowledgement" is supplied to the control apparatus 6 and confirmed in step 122.

In the above description, the plate cylinder of the printing unit 4-1 is determined as the plate cylinder n to be exchanged. However, the same operation is naturally be performed even if another plate cylinder is selected. When a plurality of plate cylinders are selected at once, operations identical to that described above are performed in a parallel manner for the respective selected plate cylinders.

In the above description, data exchange through the input/output line 7 can be performed in accordance with various methods, e.g., parallel or serial communication.

As has been described above, according to the present invention, when a plate cylinder to be exchanged is selected in step 101 and exchange start is instructed in step 102, the selected plate cylinder n is automatically reset to the origin which is optimum for plate exchange, and automatic plate exchange is performed at the origin. When plate exchange is completed, the plate cylinder n is automatically returned to the initial position. Thus, the operator need not move around between the automatic plate exchange apparatus 5 and the plate registration control apparatus 6, the load on the operator is decreased, and the operation efficiency is improved.

Figure 4:
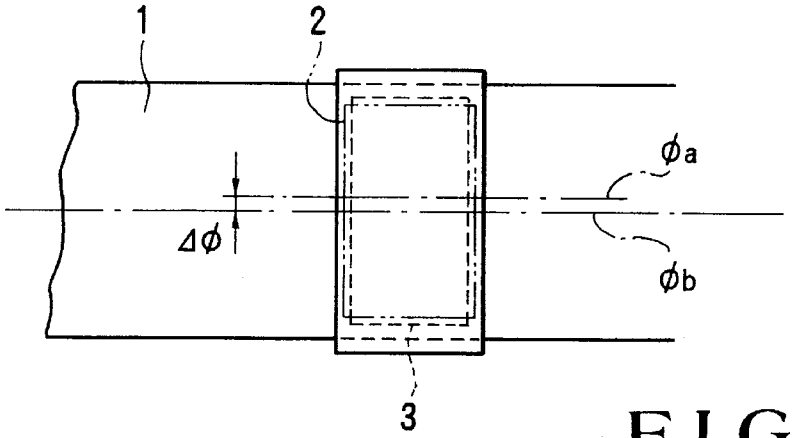
FIG. 4 is a view for explaining a deviation $\Delta\phi$ caused between a center $\phi b$ of a new plate in the right-and-left direction which is exchanged when the plate cylinder is at the origin and a center $\phi a$ of the web in the flowing direction.

Furthermore, in this embodiment, since the plate cylinder n is returned to the position immediately before it is reset to the origin, the center $\phi a$ of the web in the flowing direction automatically coincides with the center $\phi b$ of the new plate 2 in the right-and-left direction, as has been described with reference to FIG. 4. Hence, position adjustment of the plate cylinder n by using the plate registration control apparatus 6 is not needed, the load on the operator is greatly decreased, and the operating efficiency is greatly improved.

More specifically, when the plate cylinder n is located at the initial position before it is reset to the origin, the center $\phi b$ of the old plate in the right-and-left direction coincides with the center $\phi b$ of the web 1 in the flowing direction. Assume that the new plate 2 can be mounted on the plate cylinder n such that its center in the right-and-left direction coincides with the center of the old plate in the right-and-left direction. Since the deviation $\Delta\phi$ caused due to the individual characteristics or the like of the rotary press 4 is substantially constant, the center $\phi a$ of the web 1 in the flowing direction and the center $\phi b$ of the new plate 2 in the right-and-left direction can be set to coincide with each other by returning the plate cylinder n to the initial position.

If the new plate 2 cannot be mounted on the plate cylinder n such that its center in the right-and-left direction coincides with the center of the old plate in the right-and-left direction, or if the center of the new plate in the right-and-left direction and that of the old plate in the right-and-left direction do not coincide with each other due to the individual characteristics or the like of the process device, the position of the plate cylinder n which is automatically returned to the initial position may be finely adjusted.

Furthermore, according to the present invention, since automatic plate exchange is always performed after the plate cylinder is reset to the origin, occurrence of a plate exchange error can be prevented when compared to the conventional exchange method in which the plate cylinder is reset to the origin by operating the reset switch of the plate registration control apparatus. That is, in the conventional method, when automatic plate exchange is started while accidentally failing to operate the reset switch, if the plate cylinder is located outside a plate-exchangeable range, a plate exchange error occurs. In contrast to this, in the present invention, since automatic plate exchange is always performed after the plate cylinder is reset to the origin, no plate exchange error will occur.

In the present invention, the origin means a position optimum for automatic plate exchange and is not limited to the center (of the machine) of the movable range of the plate cylinder in the axial direction.

For example, a position deviated from the center of the movable range of the plate cylinder in the axial direction may be defined as the origin, or the center of the plate cylinder in the right-and-left, up-and-down (circumferential), or twisted direction may be defined as the origin.

If the center of the plate cylinder in the right-and-left, up-and-down, or twisted direction is defined as the origin, to reset the plate cylinder to this origin, the current position of the plate cylinder in a selected one of these three directions is stored. Automatic plate exchange is performed after the plate cylinder is at the origin, and the plate cylinder is moved in the right-and-left, up-and-down, or twisted direction to automatically return it to the stored current position.

More specifically, the plate cylinder tends to be deviated by a predetermined value in the same direction (the up-and-down direction) due to the individual characteristics of the process device used in the plate process. This deviation can be eliminated by returning the plate cylinder to the current position in the up-and-down direction. Especially, in a sheet printing press, since the center of the sheet in the up-and-down direction deviates from the center of the pattern on the sheet, it is important to eliminate a deviation in the up-and-down direction. Similarly, when a printing press is used, due to the deviation in the up-and-down direction in the folding machine, the web cutting position is deviated from the center of the pattern, and the position of the parallel folding is also deviated. Then, the web cutting direction must be adjusted with a cumbersome operation, and registration between units must be set due to elongation of the paper. Therefore, it is important to eliminate the deviation in the up-and-down direction.

The plate cylinder tends to be deviated by a predetermined value in the same direction (the twisted direction) due to the individual characteristics of the process device used in the plate process. This deviation (inclination of the pattern) can be eliminated by returning the plate cylinder to the current position in the twisted direction.

As is apparent from the above description, according to the present invention, automatic plate exchange is performed after the plate cylinder is reset to the origin. When plate exchange is completed, the plate cylinder is automatically returned to the initial position (a position immediately before it is reset to the origin). Thus, the operator need not move around between the automatic plate exchange apparatus and the plate registration control apparatus. The load to the operator is decreased, and the operation efficiency is improved.

What is claimed is:

1. In a printing press with a plate registration control device, an automatic plate exchange method which adjusts the position relationship of a plate cylinder relative to other cylinders in contact with the plate cylinder, said method comprising the steps of:

storing by the plate registration control device of a current position of said plate cylinder relative to the other cylinders when the plate cylinder is selected for plate exchange, said current position capable of dynamically varying from one plate exchange to the next, resetting by the plate registration control device of said plate cylinder to an origin after storage of said current position of said plate cylinder, after said plate cylinder is reset to said origin, performing automatic plate exchange to replace an old plate with a new plate in a state in which said plate cylinder is positioned to said origin, and returning by the plate registration control device of the plate cylinder with said exchanged new plate to said stored current position.

2. An automatic plate control apparatus of a printing press which adjusts the position relationship of a plate cylinder relative to other cylinders in contact with said plate cylinder, comprising:

a plate registration control unit, including, storage means for storing a current position of said plate cylinder relative to said other cylinders when said plate cylinder is selected for plate exchange, said current position capable of dynamically varying from one plate exchange to the next, reset means for resetting said plate cylinder to an origin, and return means for returning said plate cylinder with a new plate to the stored current position; and an automatic plate exchange unit including, plate exchange means for performing automatic plate exchange to replace an old plate with said new plate in a state in which said plate cylinder is positioned to said origin.

* * * * *